US011060324B2

(12) United States Patent
Liu

(10) Patent No.: US 11,060,324 B2
(45) Date of Patent: Jul. 13, 2021

(54) BAG LOCK AND UNLOCKING METHOD

(71) Applicant: DONGGUAN QINGXI KWONG WAH LOCK MFY. CO. LTD., Guangdong (CN)

(72) Inventor: Man Leung Thomas Liu, Guangdong (CN)

(73) Assignee: DONGGUAN QINGXI KWONG WAH LOCK MFY. CO. LTD., Dongguan (CN)

( * ) Notice: Subject to any disclaimer, the term of this patent is extended or adjusted under 35 U.S.C. 154(b) by 337 days.

(21) Appl. No.: 16/092,214

(22) PCT Filed: Feb. 8, 2018

(86) PCT No.: PCT/CN2018/075808
§ 371 (c)(1),
(2) Date: Oct. 8, 2018

(87) PCT Pub. No.: WO2019/153182
PCT Pub. Date: Aug. 15, 2019

(65) Prior Publication Data

US 2020/0347646 A1 Nov. 5, 2020

(51) Int. Cl.
*E05B 67/10* (2006.01)
*E05B 47/00* (2006.01)
(Continued)

(52) U.S. Cl.
CPC ..... *E05B 67/10* (2013.01); *E05B 17/10* (2013.01); *E05B 47/0012* (2013.01);
(Continued)

(58) Field of Classification Search
CPC ..... G07C 9/00563; G07C 9/00174; G07C 9/00682; E05B 67/10; E05B 65/5246; E05B 17/10; E05B 47/0603; E05B 47/0012; E05B 2047/0058; E05B 67/08; E05B 67/14; E05B 67/18; E05B 65/52; E05B 2047/0094; E05B 15/10; E05B 2047/0018
(Continued)

(56) References Cited

U.S. PATENT DOCUMENTS 207,407 A * 8/1878 Egge
264,445 A * 9/1882 Dickerman
(Continued)

FOREIGN PATENT DOCUMENTS

CN 103924848 A 7/2014

*Primary Examiner* — Lloyd A Gall

(57) ABSTRACT

A bag lock and its unlocking method, a first limiting slot is provided at a lock hook. The lock body comprises a lock bolt assembly and a rotating block, the rotating block has a locked state and an unlocked state; when the rotating block is in the unlocked state, the torsion spring provides a twisting force to disengage the first limiting slot from the lock bolt assembly, so that one end of the lock hook opposite to the torsion spring is unlocked from the lock hole to unlock the bag lock; when the rotating block is in the locked state, the rotating block limits a position of the lock bolt assembly so that the lock bolt assembly is kept to be locked inside the first limiting slot, thereby the end of the lock hook opposite to the torsion spring is fixed in the lock hole to lock the bag lock.

16 Claims, 8 Drawing Sheets

(51) Int. Cl.

| | |
|---|---|
| ***E05B 17/10*** | (2006.01) |
| ***E05B 47/06*** | (2006.01) |
| ***G07C 9/00*** | (2020.01) |
| ***E05B 65/52*** | (2006.01) |

(52) U.S. Cl.
CPC ..... *E05B 47/0603* (2013.01); *E05B 65/5246* (2013.01); *G07C 9/00563* (2013.01); *E05B 2047/0058* (2013.01)

(58) Field of Classification Search
USPC ..... 70/41–47, 277, 278.1, 278.7, 279.1
See application file for complete search history.

(56) References Cited

U.S. PATENT DOCUMENTS 555,728 A * 3/1896 Murphy
572,653 A * 12/1896 Dyer et al.
618,752 A * 1/1899 Van Cauwenberghe
695,346 A * 3/1902 Soley
882,192 A * 3/1908 Fraim
910,967 A * 1/1909 Soley
981,784 A * 1/1911 Miller
1,100,391 A * 6/1914 Murphy ..... E05B 67/18 70/45
1,104,327 A * 7/1914 Stone ..... E05B 67/10 70/43
1,142,638 A * 6/1915 Soley ..... E05B 67/10 70/43
1,300,037 A * 4/1919 Soley ..... E05B 67/10 70/43
1,419,358 A * 6/1922 Christoph ..... E05B 67/10 70/46
1,538,033 A * 5/1925 Fraim ..... E05B 67/10 70/46
1,594,218 A * 7/1926 Soley ..... E05B 67/10 70/43
7,131,299 B1 * 11/2006 Huang ..... E05B 37/0034 70/21

* cited by examiner

Pressing one end of the lock hook which is opposite to the torsion spring so that its bottom portion is pressed on a travel switch defined on a bottom part of the lock hole , then the travel switch transmits a pressure signal to a controller;

↓

The controller controls a fingerprint recognition assembly to receive the pressure signal and activates from a dormant state to recognize an user's fingerprint, the fingerprint recognition assembly passes a recognized fingerprint to the controller , the controller compares the recognized fingerprint with a preset fingerprint, when the recognized fingerprint is the same as the preset fingerprint, the controller controls a second rotating shaft of a motor main body to rotate to drive a third limiting portion to rotate, thereby pushing a third limiting slot to rotate;

↓

The third limiting slot drives the rotating block to rotate so that an unlocking wall of the rotating block faces to a second limiting slot of the lock bolt assembly, and the rotating block is disengaged from the second limiting slot;

↓

The torsion spring provides the torsion force for disengaging the first limiting slot of the lock hook from the lock hole, and the torsion force is greater than an elastic force of a transverse arch of the lock bolt assembly pushing the transverse bolt into the first limiting slot, the first limiting slot is disengaged from the first limiting portion, and the bag lock is unlocked.

Figure 9

BAG LOCK AND UNLOCKING METHOD

FIELD OF THE INVENTION

The present application relates to a technical field of a lock, and more particularly relates to a bag lock and an unlocking method.

BACKGROUND OF THE INVENTION

Bag lock refers to a special function lock that is configured to lock box-shaped products (such as luggage, suitcase, etc.).

In the prior art, normally, the lock body can only be unlocked by a fingerprint or unlocked by a key, and an energy consumption is high.

Therefore, providing a bag lock capable of being unlocked through a fingerprint or unlocked by a Persian password at the same time to make the bag lock have low energy consumption, long battery life, compact structure, and space-saving, to solve above problem in the prior art.

SUMMARY OF THE INVENTION

In order to solve the above problems of the prior art, embodiments of the present invention provide an electronic padlock with reasonable structure design and simple installation. The technical solution provides a bag lock comprising a lock body and a lock hook, one end of the lock hook is rotatably defined in the lock body and a torsion spring is defined inside the lock hook, the other end of the lock hook is configured to be inserted into a lock hole which is defined on the lock body to lock the bag lock or to be disengaged from the lock hole to unlock the bag lock.

A first limiting slot is provided on one end of the lock hook, the end of the lock hook is opposite to the torsion spring; a lock bolt assembly and a rotating block are also arranged in the lock body, the rotating block has a locked state and an unlocked state that are rotatably adjustable; and When the rotating block is in the unlocked state, the torsion spring is configured to provide a torsion force to disengage the first limiting slot from the lock bolt assembly, so that one end of the lock hook opposite to the torsion spring disengages from the lock hole to unlock the bag lock; when the rotating block is in the locked state, the rotating block is configured to limit a movement of the lock bolt assembly so that the lock bolt assembly remains being buckled in the first limiting slot, thereby the end of the lock hook opposite to the torsion spring is buckled into the lock hole to lock the bag lock.

Alternatively, the bolt assembly comprises a transverse bolt and an elastically defined transverse arch, one end of the transverse arch is fixed in the lock body, and the other end of the transverse arch is connected to the transverse bolt, the transverse arch is for elastically pushing the transverse bolt toward the first limiting slot; and The transverse bolt comprises a first limiting portion and a second limiting slot, when the rotating block is in the locked state, the rotating block is located at the second limiting slot to limit a movement of the lock bolt assembly so that the first limiting portion remains being locked in the first limiting slot to lock the bag lock.

Alternatively, the first limiting portion is defined in an arc shape, and the first limiting slot is provided with an inclined surface; and when the rotating block is in the unlocked state, the rotating block is disengaged from the second limiting slot, a torsion force of the torsion spring is greater than an elastic force of the transverse arch pushing the transverse bolt so that the first limiting slot is disengaged from the first limiting portion to unlock the bag lock.

Alternatively, a center part of the rotating block is provided with a first shaft hole, a peripheral wall of the rotating block comprises a locking wall, an unlocking wall adjacent to the locking wall, a third limiting groove, and a first concave wall and a second concave wall defined on two sides of the third limiting groove; and A first rotating shaft is fixedly defined inside the lock body, and the first rotating shaft penetrates the first shaft hole, the rotating block rotates around the first rotating shaft that acts as an axis to adjust the locked state and the unlocked state, an axis direction of the first rotating shaft is defined to be parallel to a position of the lock bolt assembly, a position of the rotating block is perpendicular to the position of the lock bolt assembly.

Alternatively, a distance between the locking wall and the first shaft hole is greater than a distance between the unlocking wall and the first shaft hole; and When the rotating block is in the unlocked state, the unlocking wall faces the second limiting slot, and the rotating block disengages from the second limiting slot; when the rotating block is in the locked state, the locking wall enters the second limiting slot to limit a lateral movement of the lock bolt assembly to lock the bag lock.

Alternatively, when the rotating block is in the locked state, a gap is defined between the locking wall and an inner wall of the second limiting slot to reduce friction between the rotating block and the second limiting slot.

Alternatively, a motor is defined in the lock body for providing power for rotating the rotating block; and The motor comprises a fixedly connected motor main body and a motor block, a second rotating shaft is defined on an end of the motor main body, and the end of the motor main body is close to the rotating block, and a second shaft hole configured to be passed through by the second rotating shaft is defined at a middle portion of the motor block, the second rotating shaft and the second shaft hole are tightly fitted so that the second rotating shaft of the motor main body is fixedly connected to the motor block.

Alternatively, the second rotating shaft and the first rotating shaft are defined in parallel;

The motor block comprises:

A base defined perpendicular to the second rotating shaft;

A blocking portion formed by a portion of the base extending opposite to the motor main body in a direction toward the second rotating shaft, and the blocking portion is provided with an arc-shaped peripheral wall adapted to the first concave wall and the second concave wall, respectively;

A third limiting portion formed by a portion of the base extending opposite to the motor main body in a direction toward the second rotating shaft; and The base, the blocking portion and the third limiting portion are integrally formed.

Alternatively, when the rotating block is in the unlocked state, an arc-shaped outer peripheral wall of the blocking portion abuts against the first concave wall; when the rotating block is in the locked state, the arc-shaped peripheral wall of the blocking portion abuts against the second concave wall;

When the rotating block is rotated from the unlocked state to the locked state or from the locked state to the unlocked state, the third limiting portion is configured to rotate into the third limiting groove to rotate the rotating block so that the arc-shaped peripheral wall of the blocking portion is rotated from a position abutting against the first concave wall to a position abutting against the second concave wall, or from a position abutting against the second concave wall to a position abutting against the first concave wall; and When the second rotating shaft of the motor body is rotated, the blocking portion and the third limiting portion of the motor block are configured to be rotated to drive the rotating block to rotate to the unlocked state and the locked state, respectively, so as to unlock or lock the luggage lock.

Alternatively, the lock body comprises:

A travel switch defined at a bottom portion of the lock hole for transmitting a pressure signal when pressed by the end of the lock hook opposite to the torsion spring;

A fingerprint recognition assembly defined at a bottom portion of the lock body for being activated from a dormant state when the travel switch is under pressure, then identifying a user's fingerprint and transmitting a recognized fingerprint;

A controller respectively and electrically connected to the travel switch, the fingerprint recognition assembly and the motor for storing a predetermined Persian password and a preset fingerprint and further controlling the fingerprint recognition assembly to be activated from a dormant state when receives the pressure signal; and a battery defined inside the lock body and electrically connected to the controller for providing electric power.

Alternatively, the controller is further configured to receive the recognized fingerprint, compare the recognized fingerprint with the preset fingerprint, and control the motor main body to rotate to drive the rotating block to the unlocked state to achieve an unlocking of the bag lock, when the recognized fingerprint is the same as the preset fingerprint; and The pressure signal comprises a locking signal transmitted when the end of the lock hook opposite to the torsion spring presses the travel switch, and an unlocking signal transmitted when the end of the lock hook opposite to the torsion spring presses the travel switch according to the predetermined Persian password.

Alternatively, when the unlocking signal is transmitted by the travel switch, the controller is configured to control the second rotating shaft of the motor main body to rotate, then the third limit portion of the motor block is driven to rotate to enter the third limiting groove of the rotating block, thereby the rotating block is pushed to rotate, so that the locking wall of the rotating block is separated from the second limiting slot of the lock bolt assembly to unlock the bag lock, while the arc-shaped outer peripheral wall of the blocking portion of the motor block abuts against the first concave wall of the rotating block; and When the travel switch transmits the locking signal, the controller is configured to control the second rotating shaft of the motor main body to rotate, then the third limit portion of the motor block is driven to rotate to enter the third limiting groove of the rotating block, thereby the rotating block is pushed to rotate, so that the locking wall of the rotating block enters into the second limiting slot of the lock bolt assembly to lock the bag lock, while the arc-shaped outer peripheral wall of the blocking portion of the motor block abuts against the second concave wall of the rotating block.

Alternatively, a housing of the lock body comprises:

a first button electrically connected to the controller for adding preset fingerprints to the controller or deleting stored preset fingerprints from the controller when pressed by a user;

a second key electrically connected to the controller for setting the predetermined Persian password stored by the controller 18 when pressed by a user; and the first button and the second button are also configured to reset the controller to factory settings when pressed at the same time.

Alternatively, the predetermined Persian password comprises at least a first duration Persian password and a second duration Persian password of different durations arranged in a preset order;

The housing of the lock body is further provided with:

A first indicator electrically connected to the controller for emitting light under the following conditions: when a bag lock function is turned on, when the travel switch is pressed by the first duration Persian password, and the user is authorized to set a preset fingerprint or a predetermined Persian password;

The second indicator light connected to the controller for emitting light under the following conditions: when the bag lock is unlocked successfully, when the user sets the preset fingerprint or the predetermined Persian password successfully, and when the travel switch is pressed by the second duration Persian password; and The third indication connected to the controller and the battery and configured to emit light when the user fails to unlock the bag lock and fails to set the preset fingerprint or the predetermined Persian password, and when a battery power is lower than a preset power.

The present invention further provides an unlocking method for controlling the bag lock, comprising following steps:

S1, pressing one end of the lock hook which is opposite to the torsion spring according to a predetermined Persian password, so that its bottom portion is pressed on a travel switch defined on a bottom part of the lock hole according to the predetermined Persian password;

S2, the travel switch transmits an unlocking signal, the controller controls a second rotating shaft of a motor main body to rotate to drive a third limit portion to rotate, thereby pushing a third limiting groove to rotate;

S3, the third limiting groove drives the rotating block to rotate so that an unlocking wall of the rotating block faces to a second limiting slot of the lock bolt assembly, and the rotating block is disengaged from the second limiting slot;

S4, the torsion spring provides the torsion force for disengaging the first limiting slot of the lock hook from the lock hole, and the torsion force is greater than an elastic force of a transverse arch of the lock bolt assembly pushing the transverse bolt into the first limiting slot, the first limiting slot is disengaged from a first limiting portion, and the bag lock is unlocked.

The present invention further provides an unlocking method for controlling the bag lock, comprising following steps:

S1, pressing one end of the lock hook which is opposite to the torsion spring so that its bottom portion is pressed on a travel switch defined on a bottom part of the lock hole, then the travel switch transmits a pressure signal to a controller;

S2, the controller controls a fingerprint recognition assembly to receive the pressure signal and activates from a dormant state to recognize a user's fingerprint, the fingerprint recognition assembly passes a recognized fingerprint to the controller, the controller compares the recognized fingerprint with a preset fingerprint, when the recognized fingerprint is the same as the preset fingerprint, the controller controls a second rotating shaft of a motor main body to rotate to drive a third limiting portion to rotate, thereby pushing a third limiting groove to rotate;

S3, the third limiting groove drives the rotating block to rotate so that an unlocking wall of the rotating block faces to a second limiting slot of the lock bolt assembly, and the rotating block is disengaged from the second limiting slot;

S4, the torsion spring provides the torsion force for disengaging the first limiting slot of the lock hook from the lock hole, and the torsion force is greater than an elastic force of a transverse arch of the lock bolt assembly pushing the transverse bolt into the first limiting slot, the first limiting slot is disengaged from the first limiting portion, and the bag lock is unlocked.

One or more technical solutions provided by the present invention have at least the following technical effects or advantages: the bag lock can be unlocked by fingerprint or the Persian password, the bag lock has low energy consumption, long battery life, compact structure, and is space-saving.

BRIEF DESCRIPTION OF THE DRAWINGS

In order to more clearly illustrate the technical solutions in the embodiments of the present invention, the drawings configured in the description of the embodiments will be briefly described below. Obviously, the drawings in the following description are merely some embodiments of the present invention. For those skilled in the art, other drawings may also be obtained based on these drawings without any creative work.

FIG. 9 is a flow chart of an unlocking method according to a third embodiment of the present invention.

DETAILED DESCRIPTION OF THE PREFERRED EMBODIMENT

In order to solve the problems existing in the prior art that the bag lock can only be unlocked by a fingerprint or unlocked by a key, and the energy consumption is high, a bag lock is provided. The specific idea is as follows: a first limiting slot is provided at one end of a lock hook opposite to the torsion spring. The lock body is also provided with a lock bolt assembly and a rotating block, the rotating block has a locked state and an unlocked state which are turnable and adjustable; when the rotating block is in the unlocked state, the torsion spring is configured to provide a twisting force to disengage the first limiting slot from the lock bolt assembly, so that one end of the lock hook opposite to the torsion spring is unlocked from the lock hole to unlock the bag lock; when the rotating block is in the locked state, the rotating block is configured to limit a position of the lock bolt assembly so that the lock bolt assembly is kept to be locked inside the first limiting slot, thereby one end of the lock hook opposite to the torsion spring is fixed in the lock hole to lock the bag lock. The bag lock provided by the invention can be unlocked through a fingerprint or a Persian password at the same time, which has low energy consumption, long battery life, compact structure, and is space saving.

Figure 1:
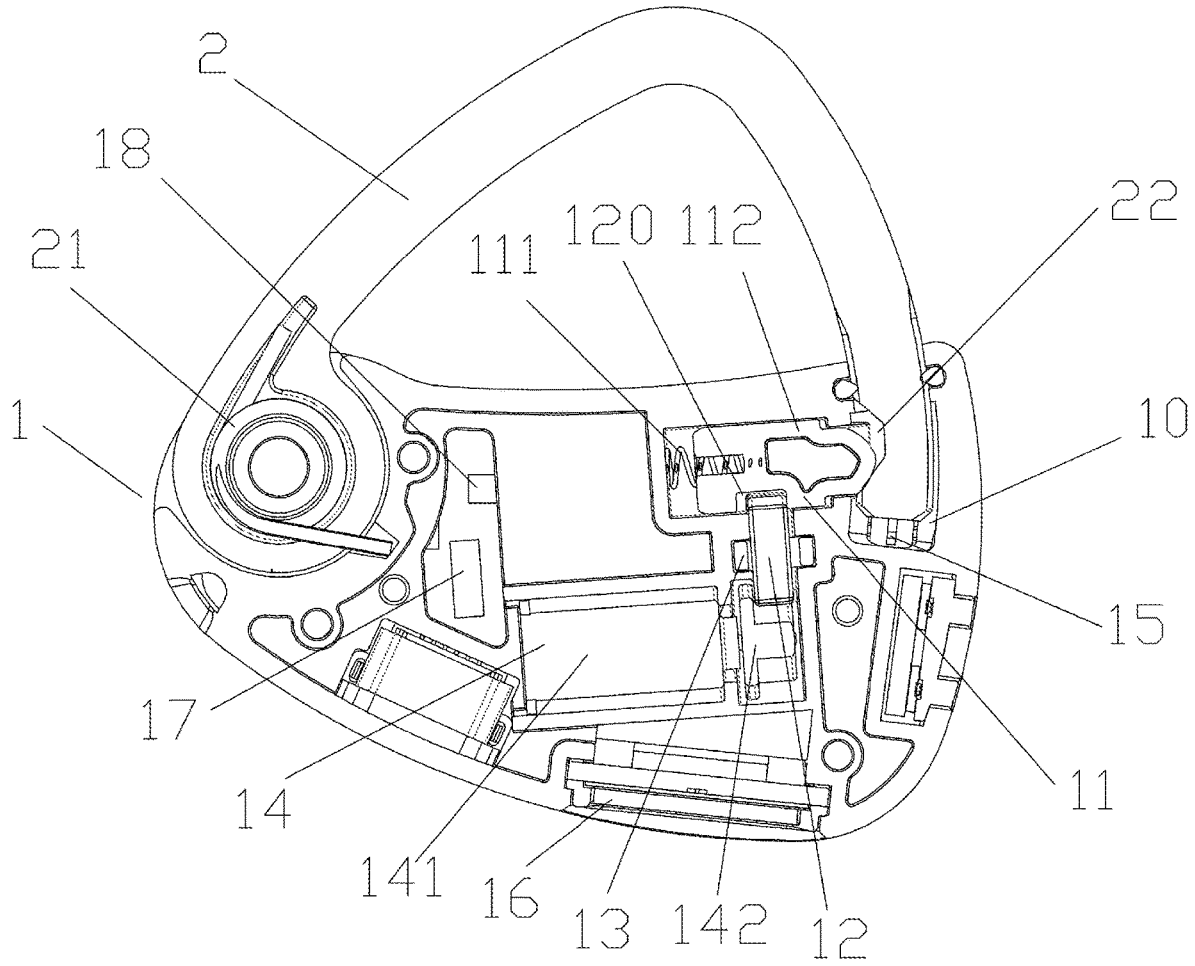
FIG. 1 is a cross-sectional view of a bag lock provided by a first embodiment of the present invention.

As shown in FIG. 1, a first embodiment of the present invention provides a bag lock comprising a lock body 1 and a lock hook 2, one end of the lock hook 2 is rotatably defined in the lock body 1 and a torsion spring 21 is defined inside the lock hook 2, the other end of the lock hook 2 is configured to be inserted into the lock hole 10 defined on the lock body 1 to lock the bag lock or to be disengaged from the lock hole 10 to unlock the bag lock, a first limiting slot 22 is provided on one end of the lock hook 2 opposite to the torsion spring 21, and a lock bolt assembly 11 and a rotating block 12 are also arranged in the lock body 1. The rotating block 12 has a locked state and an unlocked state that are rotatably adjustable; when the rotating block 12 is in the unlocked state, the torsion spring 21 is configured to provide a torsion force to disengage the first limiting slot 22 from the lock bolt assembly 11, so that one end of the lock hook 2 opposite to the torsion spring 21 disengages from the lock hole 10 to unlock the bag lock; when the rotating block 12 is in the locked state, the rotating block 12 is configured to limit a movement of the lock bolt assembly 11 so that the lock bolt assembly 11 remains being buckled in the first limiting slot 22, thereby one end of the lock hook 2 opposite to the torsion spring 21 is buckled into the lock hole 10 to lock the bag lock.

Specifically, the bolt assembly 11 comprises a transverse bolt 112 and an elastically defined transverse arch 111. One end of the transverse arch 111 is fixed in the lock body 1, and the other end is connected to the transverse bolt 112. The transverse arch 111 is for elastically pushing the transverse bolt 112 toward the first limiting slot 22.

Figure 2:
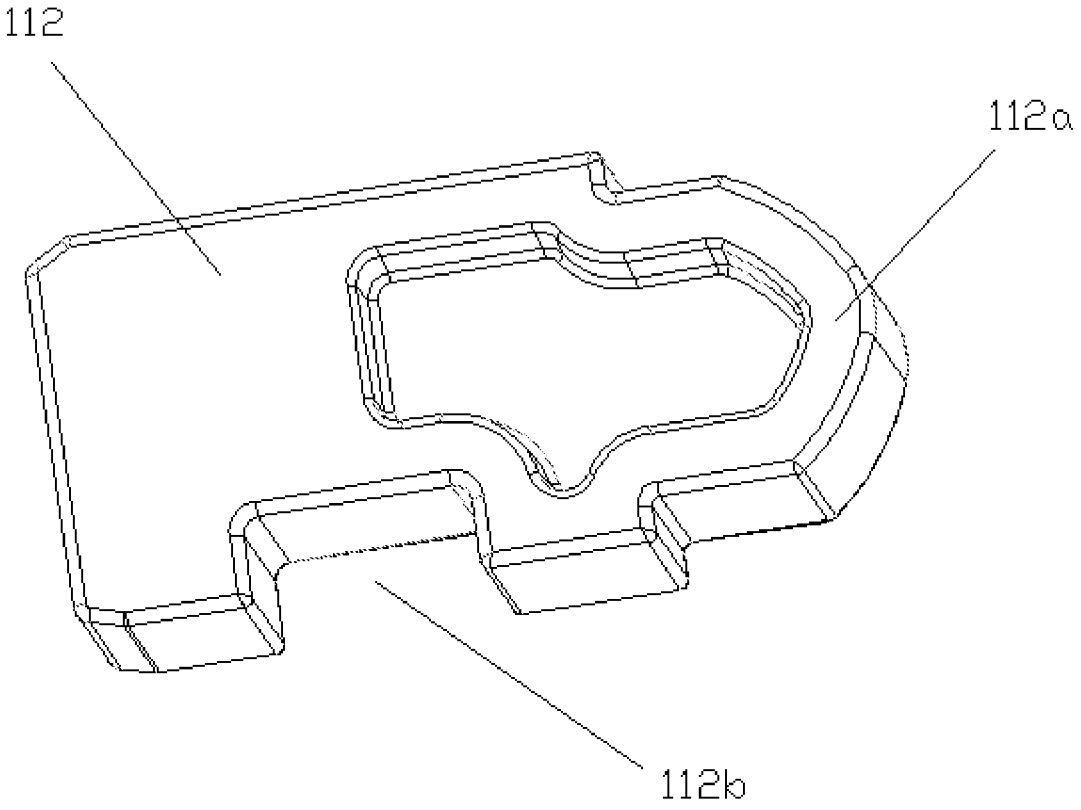
FIG. 2 is a cross-sectional structural schematic diagram of the transverse bolt in FIG. 1.

As shown in FIG. 1 and FIG. 2, the transverse bolt 112 comprises a first limiting portion 112*a* and a second limiting slot 112*b*. When the rotating block 12 is in the locked state, the rotating block 12 is located at the second limiting slot 112*b* to limit a movement of the lock bolt assembly 11 so that the first limiting portion 112*a* remains being locked in the first limiting slot 22 to lock the bag lock. The first limiting portion 112*a* is defined in an arc shape, and the first limiting slot 22 is provided with an inclined surface; when the rotating block 12 is in the unlocked state, the rotating block 12 is disengaged from the second limiting slot 112*b*, a torsion force of the torsion spring 21 is greater than an elastic force of the transverse arch 111 pushing the transverse bolt 112 so that the first limiting slot 22 is disengaged from the first limiting portion 112*a* to unlock the bag lock.

Figure 3:
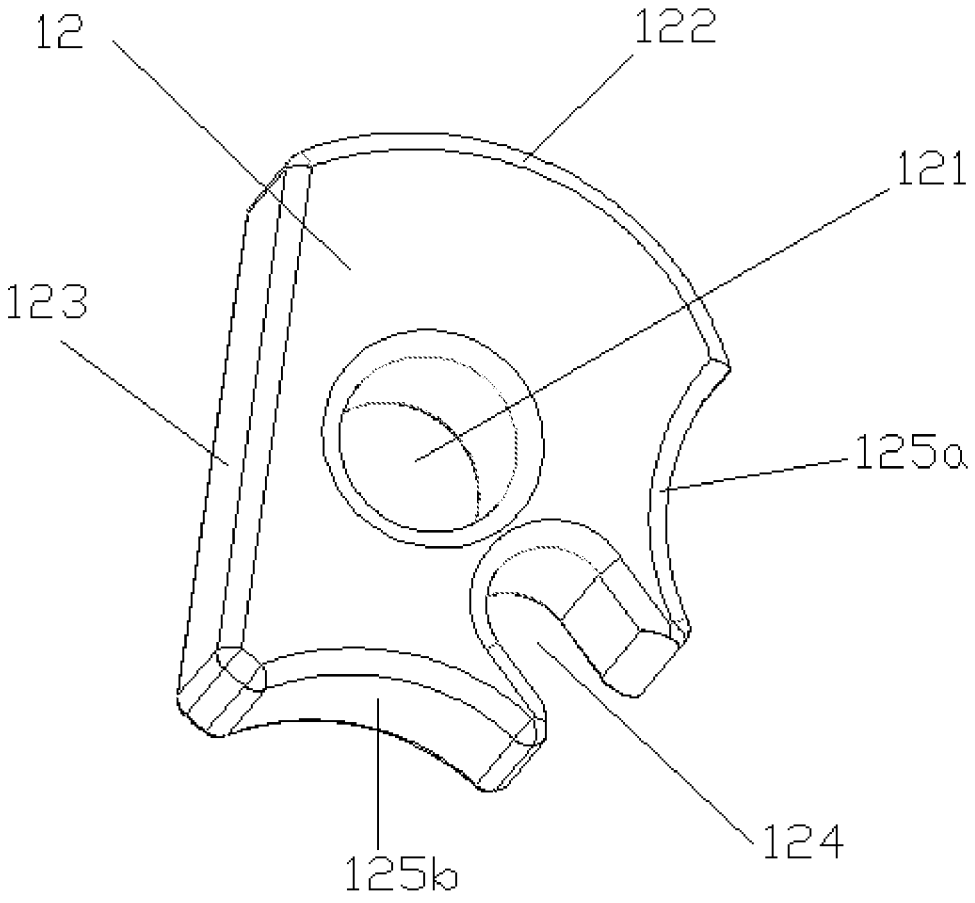
FIG. 3 is a structural schematic diagram of the rotating block in FIG. 1.

As shown in FIG. 1 and FIG. 3, a center part of the rotating block 12 is provided with a first shaft hole 121, a peripheral wall of the rotating block 12 comprises a locking wall 122, an unlocking wall 123 adjacent to the locking wall 122, a third limiting groove 124, and two concave walls 125 defined on two sides of the third limiting groove 124; a first rotating shaft 13 is fixedly defined inside the lock body 1, and the first rotating shaft 13 penetrates the first shaft hole 121. The rotating block 12 rotates around the first rotating shaft 13 that acts as an axis to adjust the locked state and the unlocked state. An axis direction of the first rotating shaft 13 is defined to be parallel to the position of the lock bolt assembly 11. The position of the rotating block 12 is perpendicular to the position of the lock bolt assembly 11.

In this embodiment, a distance between the locking wall 122 and the first shaft hole 121 is greater than a distance between the unlocking wall 123 and the first shaft hole 121; when the rotating block 12 is in the unlocked state, the unlocking wall 123 faces the second limiting slot 112*b*, and the rotating block 12 disengages from the second limiting slot 112*b*; when the rotating block 12 is in the locked state, the locking wall 122 enters the second limiting slot 112*b* to limit a lateral movement of the lock bolt assembly 11 to lock the bag lock.

Figure 4:
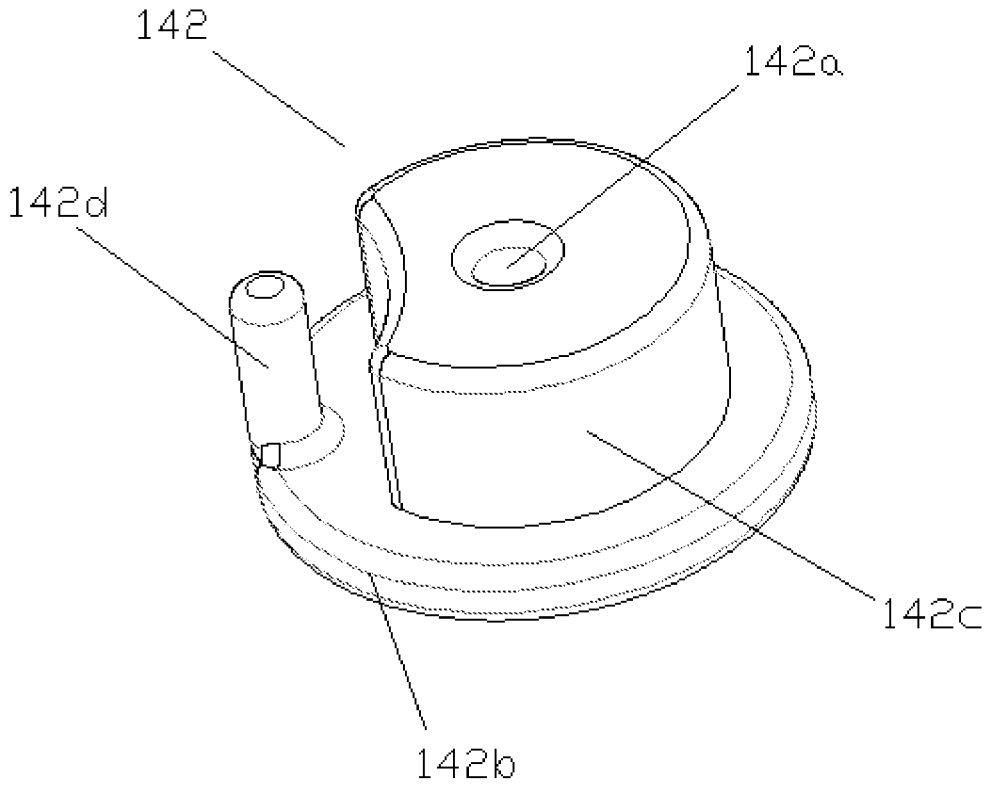
FIG. 4 is a structural schematic diagram of the motor block in FIG. 1.
Figure 5:
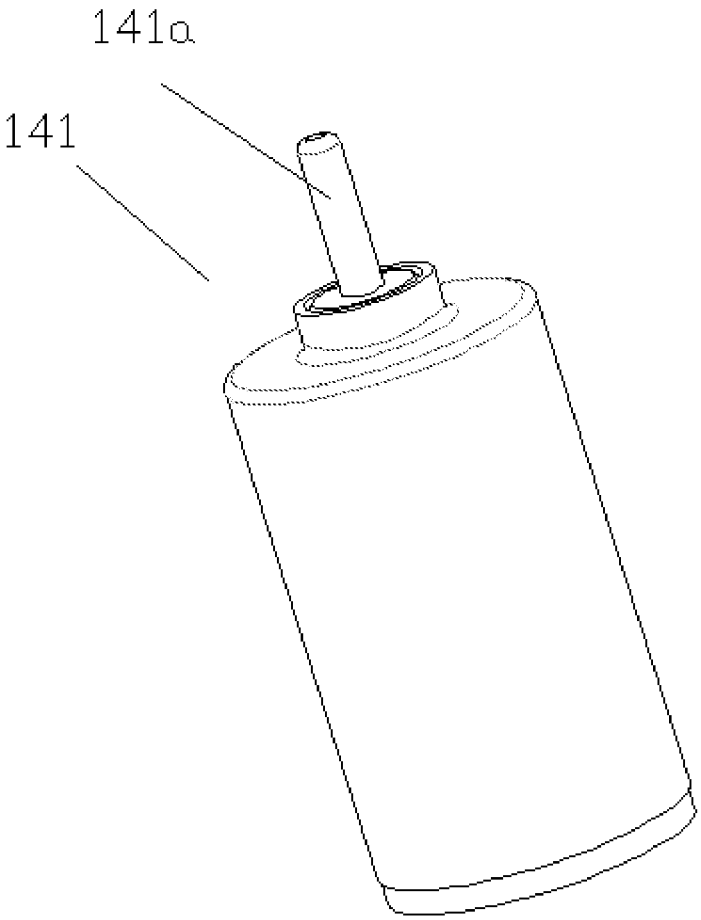
FIG. 5 is a structural schematic diagram of a motor main body structure in FIG. 1.

As shown in FIG. 1, FIG. 4 and FIG. 5, a motor 14 is defined in the lock body 1. The motor 14 is configured for providing power for rotating the rotating block 12. The motor 14 comprises a fixedly connected motor main body 141 and a motor block 142, a second rotating shaft 141*a* is defined on an end of the motor main body 141 close to the rotating block 12, and a second shaft hole 142*a* configured to be passed through by the second rotating shaft 141*a* is defined at a middle portion of the motor block 142. The second rotating shaft 141*a* and the second shaft hole 142*a* are tightly fitted so that the second rotating shaft 141*a* of the motor main body 141 is fixedly connected to the motor block 142.

As shown in FIG. 1, when the rotating block 12 is in the locked state, a gap 120 is defined between the locking wall 122 and an inner wall of the second limiting slot 112*b* to reduce friction between the rotating block 12 and the second limiting slot 112*b*. The arrangement of the gap 120 greatly reduces the friction of the rotating block 12 to further reduce power required by the motor 14 to drive the rotating block 12, thereby to achieve more effort and power saving.

As shown in FIG. 1 and FIG. 4, the second rotating shaft 141*a* and the first rotating shaft 13 are defined in parallel; the motor block 142 comprises a base 142*b* defined perpendicular to the second rotating shaft 141*a*; a blocking portion 142*c* formed by a portion of the base 142*b* extending opposite to the motor main body 141 in a direction toward the second rotating shaft 141*a*, and the blocking portion 142*c* is provided with an arc-shaped peripheral wall adapted to a first concave wall 125*a* and a second concave wall 125*b*, respectively; a third limiting portion 142*d* formed by a portion of the base 142*b* extending opposite to the motor main body 141 in a direction toward the second rotating shaft 141*a*; and the base 142*b*, the blocking portion 142*c* and the third limiting portion 142*d* are integrally formed.

Specifically, when the rotating block 12 is in the unlocked state, the arc-shaped outer peripheral wall of the blocking portion 142*c* abuts against the first concave wall 125*a*; when the rotating block 12 is in the locked state, the arc-shaped peripheral wall of the blocking portion 142*c* abuts against the second concave wall 125*b*; when the rotating block 12 is rotated from the unlocked state to the locked state or from the locked state to the unlocked state, the third limiting portion 142*d* is used to rotate into the third limiting groove 124 to rotate the rotating block 12 so that the arc-shaped peripheral wall of the blocking portion 142*c* is rotated from a position abutting against the first concave wall 125*a* to a position abutting against the second concave wall 125*b*, or from a position abutting against the second concave wall 125*b* to a position abutting against the first concave wall 125*a*. When the second rotating shaft 141*a* of the motor body 141 is rotated, the blocking portion 142*c* and the third limiting portion 142*d* of the motor block 142 is used to be rotated to drive the rotating block 12 to rotate to the unlocked state or the locked state, respectively, so as to unlock or lock the bag lock.

As shown in FIG. 1, the lock body 1 further comprises: a travel switch 15 defined at a bottom portion of the lock hole 10 for transmitting a pressure signal when pressed by one end of the lock hook 2 opposite to the torsion spring 21; a fingerprint recognition assembly 16 defined at a bottom portion of the lock body 1 for being activated from a dormant state when the travel switch 15 is under pressure, then identifying a user's fingerprint and transmitting a recognized fingerprint; a controller 18 respectively and electrically connected to the travel switch 15, the fingerprint recognition assembly 16 and the motor 14 for storing a predetermined Persian password and a preset fingerprint and further controlling the fingerprint recognition assembly 16 to be activated from a dormant state when receives the pressure signal; a battery 17 defined inside the lock body 1 and electrically connected to the controller 18 for providing electric power. The fingerprint recognition assembly 16 is activated from a dormant state when the travel switch 15 is pressed to save power.

In this embodiment, the controller 18 is further configured to receive the recognized fingerprint, compare the recognized fingerprint with the preset fingerprint, and control the motor main body 141 to rotate to drive the rotating block 12 to the unlocked state to achieve an unlocking of the bag lock, when the recognized fingerprint is the same as the preset fingerprint.

In this embodiment, fingerprinting algorithm of the fingerprint recognition assembly 16 is the Precise Biometrics algorithm, a fingerprint chip is a M4 chip, a fingerprint capacity is 256 kb, and a fingerprint matching speed is within 1 s, the fingerprint recognition assembly 16 in this embodiment can set multiple fingerprints.

Specifically, the Persian password is a password, such as long, short, long, long, short, and the like, that is achieved by making contact with the travel switch 15 for a long time, such as 2 s, or for a short time, for example, 1 s. When the bag lock is in the locked state, a bottom portion of one end of the lock hook 2 is kept at a distance from the travel switch 15 under a torsion force of the torsion spring 21, the end of the lock hook 2 is opposite to the torsion spring 21; when the Persian password needs to be configured to unlock the bag lock, manually press the lock hook 2 downwards, a bottom portion of the lock hook 2 is in contact with the travel switch 15, and the lock hook 2 is pressed repeatedly for a long time or a short time according to requirements of the Persian password. When the Persia password is correct, the controller 18 controls the motor 14 rotate to drive the rotating block 12 to rotate to the unlocked state to open the bag lock.

In this embodiment, the pressure signal comprises a locking signal transmitted when the end of the lock hook 2 that is opposite to the torsion spring 21 presses the travel switch 15, and an unlocking signal transmitted when one end of the lock hook 2 that is opposite to the torsion spring 21 presses the travel switch 15 according to a predetermined Persian password.

Specifically, when the travel switch 15 transmits the locking signal, the controller 18 is configured to control a rotation of the second rotating shaft 141*a* of the motor main body 141 to drive a rotation of the blocking portion 142*c*, so as to push the concave wall 125 to rotate, thereby the rotating block 12 enters the lock bolt assembly 11 to lock the bag lock, and the third limiting portion 142*d* rotates into the third limiting groove 124; when the unlocking signal is transmitted by the travel switch 15, the controller 18 is configured to control the second rotating shaft 141*a* of the motor main body 141 to rotate, then the third limit portion 142*d* is driven to rotate to push the third limiting groove 124 to rotate, thereby the rotating block 12 is disengaged from the lock bolt assembly 11 to unlock the bag lock, while the arc-shaped outer peripheral wall of the blocking portion 142*c* abuts against the concave wall 125.

Figure 6:
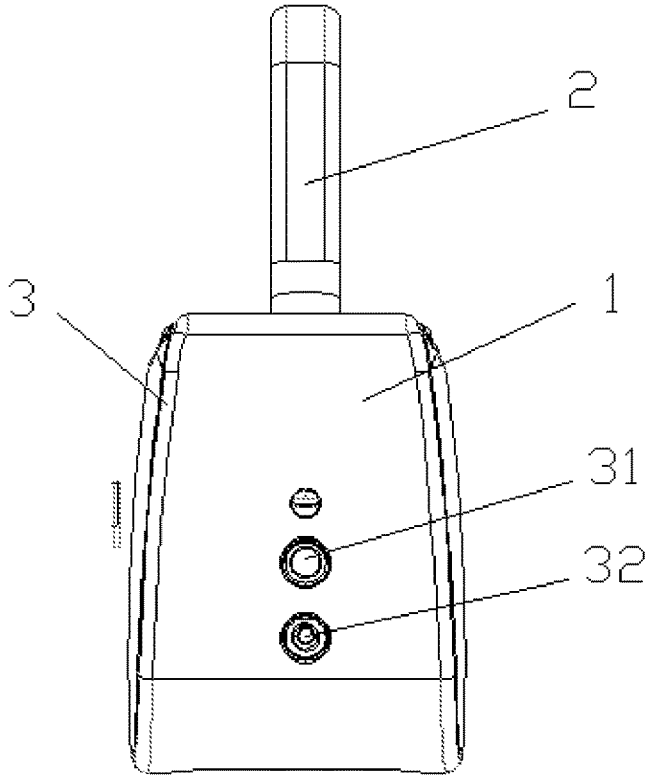
FIG. 6 is a right side view of the bag lock provided by the first embodiment of the present invention.

As shown in FIG. 6, a housing 3 of the lock body 1 comprises: a first button 31 electrically connected to the controller 18 for adding preset fingerprints to the controller 18 or deleting stored preset fingerprints from the controller 18 when pressed by a user; a second key 32 electrically connected to the controller 18 for setting the predetermined Persian password stored by the controller 18 when pressed by a user; the first button 31 and the second button 32 are also configured to reset the controller 18 to factory settings when pressed at the same time.

Specifically, the predetermined Persian password comprises at least a first duration Persian password and a second duration Persian password of different durations arranged in a preset order. In this embodiment, the first duration Persian password is a long Persian password, and the second duration is a short Persian password.

Figure 7:
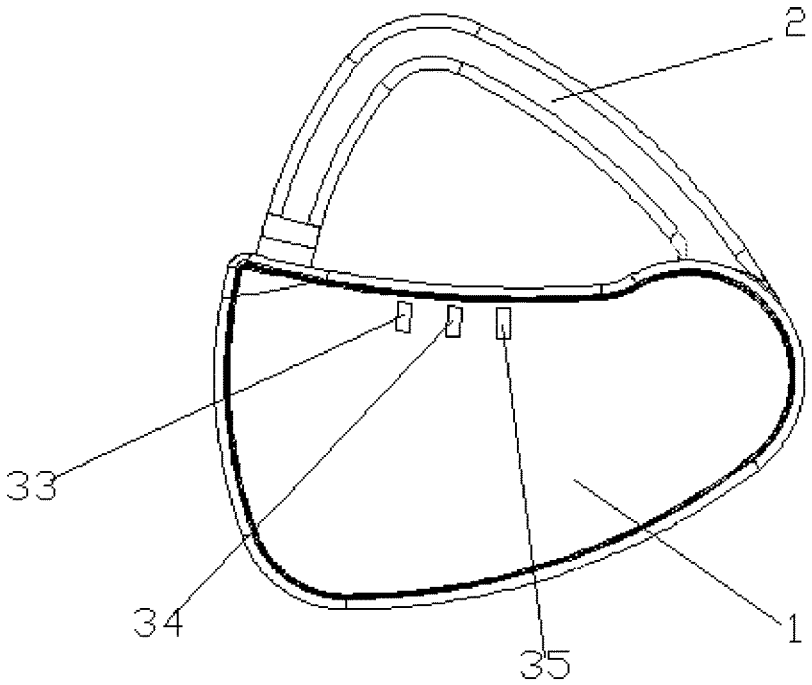
FIG. 7 is a front view of the bag lock provided by the first embodiment of the present invention.

As shown in FIG. 7, the housing 3 of the lock body 1 is further provided with a first indicator 33, which is a blue lamp in this embodiment, is electrically connected to the controller 18 for emitting light under the following conditions: When a bag lock function is turned on, when the travel switch 15 is pressed by the first duration Persian password, and the user is authorized to set a preset fingerprint or a predetermined Persian password, the second indicator light 34 is a green light in this embodiment, and is connected to the controller 18 for emitting light under the following conditions: when the bag lock is unlocked successfully, when the user sets a preset fingerprint or the predetermined Persian password successfully, and when the travel switch 15 is pressed by the second duration Persian password; the third indication 35, which is a red light in this embodiment, is connected to the controller 18 and the battery 17 and is configured to emit light when the user fails to unlock the bag lock and fails to set a preset fingerprint or preset a Persian password, and when the battery power is lower than a preset power.

The Second Embodiment

Figure 8:
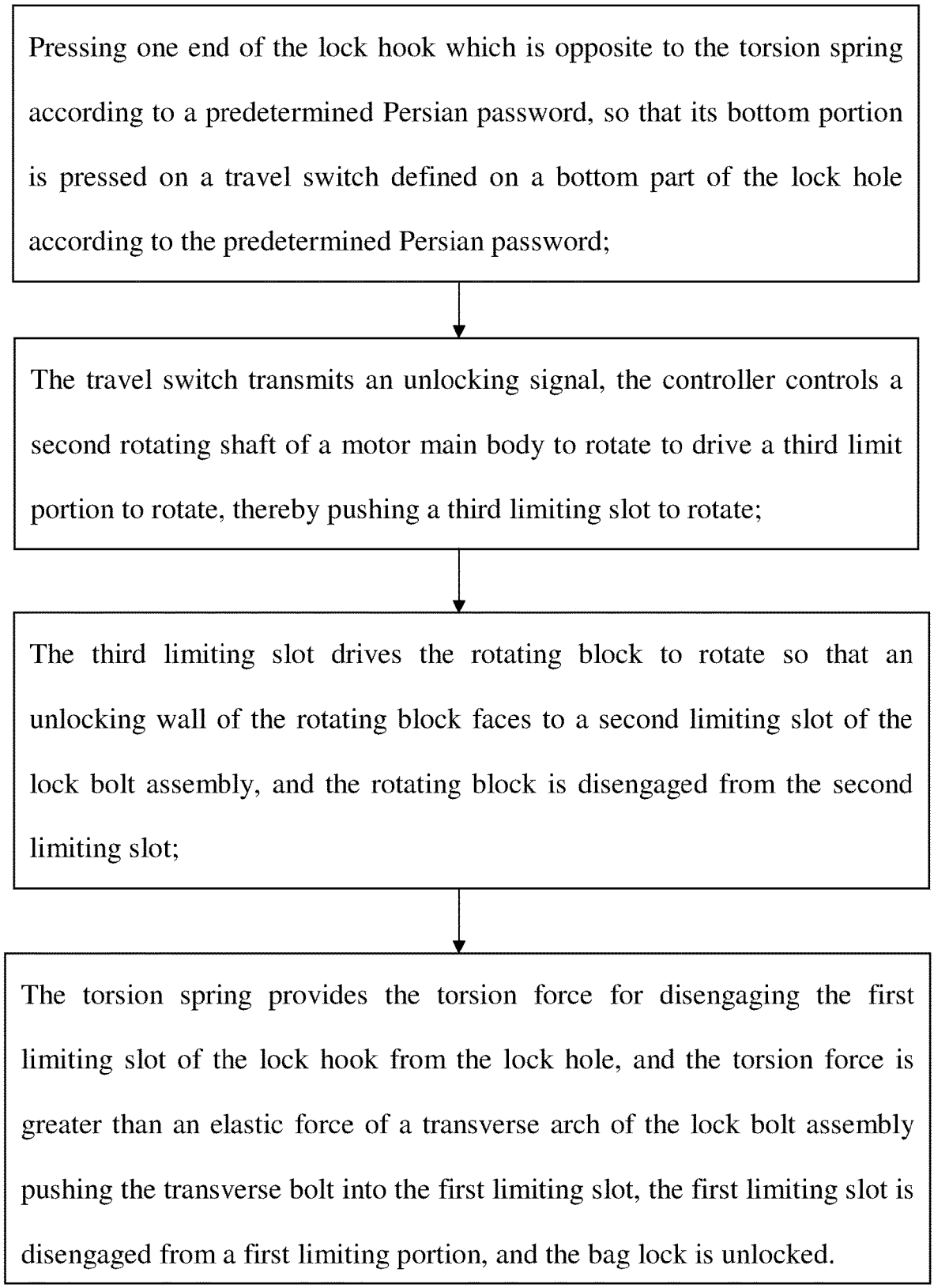
FIG. 8 is a flow chart of an unlocking method according to a second embodiment of the present invention.

As shown in FIG. 8, the second embodiment of the present invention further provides an embodiment of an unlocking method for controlling a bag lock, the unlocking method uses a Persian password to unlock the bag lock, and comprises the following steps:

S1, pressing one end of a lock hook 2 which is opposite to a torsion spring 21 according to a predetermined Persian password, so that its bottom portion is pressed on a travel switch 15 defined on a bottom part of a lock hole 10 according to the predetermined Persian password;

S2, the travel switch 15 transmits an unlocking signal, the controller 18 controls a second rotating shaft 141*a* of a motor main body 141 to rotate to drive a third limit portion 142*d* to rotate, thereby pushing a third limiting groove 124 to rotate;

S3, the third limiting groove 124 drives a rotating block 12 to rotate so that an unlocking wall 123 of the rotating block 12 faces to a second limiting slot 112*b* of a lock bolt assembly 11, and the rotating block 12 is disengaged from the second limiting slot 112*b;*

S4, the torsion spring 21 provides a torsion force for disengaging a first limiting slot 22 of the lock hook 2 from the lock hole 10, and the torsion force is greater than an elastic force of a transverse arch 111 of the lock bolt assembly 11 pushing the transverse bolt 112 into the first limiting slot 22, the first limiting slot 22 is disengaged from the first limiting portion 112*a*, and the bag lock is unlocked.

The Third Embodiment

As shown in FIG. 9, a third embodiment of the present invention further provides an embodiment of an unlocking method for controlling a bag lock, the unlocking method uses a fingerprint password to unlock the bag lock, and comprises the following steps:

S1, pressing one end of a lock hook 2 which is opposite to a torsion spring 21 so that its bottom portion is pressed on a travel switch 15 defined on a bottom part of a lock hole 10, then the travel switch 15 transmits a pressure signal to a controller 18;

S2, the controller 18 controls a fingerprint recognition assembly 16 to receive the pressure signal and activates from a dormant state to identify a user's fingerprint, the fingerprint recognition assembly 16 passes a recognized fingerprint to the controller 18, the controller 18 compares the recognized fingerprint with a preset fingerprint, when the recognized fingerprint is the same as the preset fingerprint, the controller 18 controls a second rotating shaft 141*a* of a motor main body 141 to rotate to drive a third limiting portion 142*d* to rotate, thereby pushing a third limiting groove 124 to rotate;

S3, the third limiting groove 124 drives a rotating block 12 to rotate so that an unlocking wall 123 of the rotating block 12 faces to a second limiting slot 112*b* of a lock bolt assembly 11, and the rotating block 12 is disengaged from the second limiting slot 112*b;*

S4, the torsion spring 21 provides a torsion force for disengaging a first limiting slot 22 of the lock hook 2 from the lock hole 10, and the torsion force is greater than an elastic force of a transverse arch 111 of the lock bolt assembly 11 pushing the transverse bolt 112 into the first limiting slot 22, the first limiting slot 22 is disengaged from the first limiting portion 112*a*, and the bag lock is unlocked.

The first specific use method of the bag lock in this embodiment is as follows:

(1) Firstly, using the factory Persian password to unlock the bag lock: Press a second button 32 with an appropriate object, a blue light will flash, enter a predetermined Persian password by a long press and a short press on a lock hook 2, when the Persian password is correct, the lock hook 2 will automatically pop up;

(2) Setting a preset fingerprint: When the bag lock is unlocked, press a first button 31 with an appropriate object, the blue light will flash, indicating that the fingerprint recognition assembly 16 is ready, put a finger to be collected into the fingerprint recognition assembly 16, and the fingerprint will be collected automatically, different finger positions are required to be multiply collected, when a successful fingerprint collection is completed, a green light will flash for 0.2 seconds; if the collection fails, a red light will flash for 0.2 seconds. After 6 collections of fingerprint are completed, the green light will flash for 2 seconds.

(3) Setting a Persian password: After the completion of the preset fingerprint collection, the Persian password can be set. When setting the Persian password, press the second button 32 with an appropriate object twice. The blue light will flash. At this time, the preset fingerprint is inputted, if a fingerprint matching is failed, the red light flash 1 s, if a fingerprint matching is successful, the green light flash 10 s, the predetermined Persian password must be entered within the 10 s, a short press makes the green light flash 0.2 s, a long press enable the green light to flash firstly and then the blue light is turned to flash 0.5 s. After the Persian password input is completed, the green light flashes 2 s to indicate that the setting is successful;

(4) Setting a new user's fingerprint: Press the first button 31 with an appropriate object, blue light flashes, press an initial preset fingerprint at this time, if a fingerprint matching is successful, the green light flash 10 s, a new fingerprint must be entered within the 10 s, after the new fingerprint is collected, the green light flashes 2 s to indicate a successful authorization;

(5) Deleting fingerprints: Press and hold the first button 31 with an appropriate object. When the blue light and the red light flash at the same time, enter an operated fingerprint. After a successful match, the green light will be turned on for 2 seconds to indicate that the fingerprint is deleted successfully. At this time, deleted fingerprints refer to fingerprints other than the operated fingerprint;

(6) Deleting the Persian password: Press the second button 32 with an appropriate object, and enter an operated fingerprint when the red light and blue light flash at the same time. After a successful match, the green light will be displayed 2 s to indicate that the Persian password has been deleted successfully. If a set Persian password is deleted, a factory set Persian password will be reset;

(7) Restoring factory settings: Press the first button 31 and the second button 32 at the same time with an appropriate object, and enter an operated fingerprint when the red light and blue light flash at the same time. After a successful match, the green light will flash for 1 s, indicating that the lock has been reset to factory settings.

In summary, the present application scheme has at least the following beneficial technical effects with respect to the prior art:

It can be unlocked by fingerprint or unlocked by Persian password. It has low energy consumption, long battery life, compact structure, and it is space saving.

What is disclosed above is only a preferred embodiment of the present invention, and certainly cannot be configured to limit the scope of rights of the present invention. Those skilled in the art can understand all or part of the processes for implementing the above embodiments, and according to the present invention, the equivalent change requested is still within the scope of the invention.

The invention claimed is:

1. A bag lock comprising a lock body (1) and a lock hook (2), one end of the lock hook (2) is rotatably defined in the lock body (1) and a torsion spring (21) is defined inside the lock hook (2), the other end of the lock hook (2) is configured to be inserted into a lock hole (10) which is defined in the lock body (1) to lock the bag lock or to be disengaged from the lock hole (10) to unlock the bag lock, wherein a first limiting slot (22) is provided on one end of the lock hook (2), the end of the lock hook (2) is opposite to the torsion spring (21); a lock bolt assembly (11) and a rotating block (12) are also arranged in the lock body (1), the rotating block (12) has a locked state and an unlocked state that are rotatably adjustable; and wherein when the rotating block (12) is in the unlocked state, the torsion spring (21) is configured to provide a torsion force to disengage the first limiting slot (22) from the lock bolt assembly (11), so that one end of the lock hook (2) opposite to the torsion spring (21) disengages from the lock hole (10) to unlock the bag lock; when the rotating block (12) is in the locked state, the rotating block (12) is configured to limit a movement of the lock bolt assembly (11) so that the lock bolt assembly (11) remains being buckled in the first limiting slot (22), thereby the end of the lock hook (2) opposite to the torsion spring (21) is buckled into the lock hole (10) to lock the bag lock.

2. The bag lock according to claim 1, wherein the bolt assembly (11) comprises a transverse bolt (112) and an elastically defined transverse arch (111), one end of the transverse arch (111) is fixed in the lock body (1), and the other end of the transverse arch (111) is connected to the transverse bolt (112), the transverse arch (111) is for elastically pushing the transverse bolt (112) toward the first limiting slot (22); and wherein the transverse bolt (112) comprises a first limiting portion (112*a*) and a second limiting slot (112*b*), when the rotating block (12) is in the locked state, the rotating block (12) is located at the second limiting slot (112*b*) to limit a movement of the lock bolt assembly (11) so that the first limiting portion (112*a*) remains being locked in the first limiting slot (22) to lock the bag lock.

3. The bag lock according to claim 2, wherein the first limiting portion (112*a*) is defined in an arc shape, and the first limiting slot (22) is provided with an inclined surface; and wherein when the rotating block (12) is in the unlocked state, the rotating block (12) is disengaged from the second limiting slot (112*b*), a torsion force of the torsion spring (21) is greater than an elastic force of the transverse arch (111) pushing the transverse bolt (112) so that the first limiting slot (22) is disengaged from the first limiting portion (112*a*) to unlock the bag lock.

4. The bag lock according to claim 3, wherein a center part of the rotating block (12) is provided with a first shaft hole (121), a peripheral wall of the rotating block (12) comprises a locking wall (122), an unlocking wall (123) adjacent to the locking wall (122), a third limiting groove (124), and a first concave wall (125*a*) and a second concave wall (125*b*) defined on two sides of the third limiting groove (124); and wherein a first rotating shaft (13) is fixedly defined inside the lock body (1), and the first rotating shaft (13) penetrates the first shaft hole (121), the rotating block (12) rotates around the first rotating shaft (13) that acts as an axis to adjust the locked state and the unlocked state, an axis direction of the first rotating shaft (13) is defined to be parallel to a position of the lock bolt assembly (11), a position of the rotating block (12) is perpendicular to the position of the lock bolt assembly (11).

5. The bag lock according to claim 4, wherein a distance between the locking wall (122) and the first shaft hole (121) is greater than a distance between the unlocking wall (123) and the first shaft hole (121); and wherein when the rotating block (12) is in the unlocked state, the unlocking wall (123) faces the second limiting slot (112*b*), and the rotating block (12) disengages from the second limiting slot (112*b*); when the rotating block (12) is in the locked state, the locking wall (122) enters the second limiting slot (112*b*) to limit a lateral movement of the lock bolt assembly (11) to lock the bag lock.

6. The bag lock according claim 5, wherein when the rotating block (12) is in the locked state, a gap (120) is defined between the locking wall (122) and an inner wall of the second limiting slot (112*b*) to reduce friction between the rotating block (12) and the second limiting slot (112*b*).

7. The bag lock according claim 4, wherein a motor (14) is defined in the lock body (1) for providing power for rotating the rotating block (12); and wherein the motor (14) comprises a fixedly connected motor main body (141) and a motor block (142), a second rotating shaft (141*a*) is defined on an end of the motor main body (141), and the end of the motor main body (141) is close to the rotating block (12), and a second shaft hole (142*a*) configured to be passed through by the second rotating shaft (141*a*) is defined at a middle portion of the motor block (142), the second rotating shaft (141*a*) and the second shaft hole (142*a*) are tightly fitted so that the second rotating shaft (141*a*) of the motor main body (141) is fixedly connected to the motor block (142).

8. The bag lock according claim 7, wherein the second rotating shaft (141*a*) and the first rotating shaft (13) are defined in parallel;

wherein the motor block (142) comprises:

a base (142*b*) defined perpendicular to the second rotating shaft (141*a*);

a blocking portion (142*c*) formed by a portion of the base (142*b*) extending opposite to the motor main body (141) in a direction toward the second rotating shaft (141*a*), and the blocking portion (142*c*) is provided with an arc-shaped peripheral wall adapted to the first concave wall (125*a*) and the second concave wall (125*b*), respectively;

a third limiting portion (142*d*) formed by a portion of the base (142*b*) extending opposite to the motor main body (141) in a direction toward the second rotating shaft (141*a*); and the base (142*b*), the blocking portion (142*c*) and the third limiting portion (142*d*) are integrally formed.

9. The bag lock according to claim 8, wherein when the rotating block (12) is in the unlocked state, an arc-shaped outer peripheral wall of the blocking portion (142*c*) abuts against the first concave wall (125*a*); when the rotating block (12) is in the locked state, the arc-shaped peripheral wall of the blocking portion (142*c*) abuts against the second concave wall (125*b*);

wherein when the rotating block (12) is rotated from the unlocked state to the locked state or from the locked state to the unlocked state, the third limiting portion (142*d*) is configured to rotate into the third limiting groove (124) to rotate the rotating block (12) so that the arc-shaped peripheral wall of the blocking portion (142*c*) is rotated from a position abutting against the first concave wall (125*a*) to a position abutting against the second concave wall (125*b*), or from a position abutting against the second concave wall (125*b*) to a position abutting against the first concave wall (125*a*); and wherein when the second rotating shaft (141*a*) of the motor body (141) is rotated, the motor block (142) is configured to be rotated to drive the rotating block (12) to rotate to the unlocked state and the locked state, respectively, so as to unlock or lock the luggage lock.

10. The bag lock according to claim 8, wherein the lock body (1) comprises:

a travel switch (15) defined at a bottom portion of the lock hole (10) for transmitting a pressure signal when pressed by the end of the lock hook (2) opposite to the torsion spring (21);

a fingerprint recognition assembly (16) defined at a bottom portion of the lock body (1) for being activated from a dormant state when the travel switch (15) is under pressure, then identifying a user's fingerprint and transmitting a recognized fingerprint;

a controller (18) respectively and electrically connected to the travel switch (15), the fingerprint recognition assembly (16) and the motor (14) for storing a predetermined Persian password and a preset fingerprint and further controlling the fingerprint recognition assembly (16) to be activated from a dormant state when receives the pressure signal; and a battery (17) defined inside the lock body (1) and electrically connected to the controller (18) for providing electric power.

11. The bag lock according to claim 10, wherein the controller (18) is further configured to receive the recognized fingerprint, compare the recognized fingerprint with the preset fingerprint, and control the second rotating shaft (141*a*) to be rotated to drive the rotating block (12) to the unlocked state to achieve an unlocking of the bag lock, when the recognized fingerprint is the same as the preset fingerprint; and wherein the pressure signal comprises a locking signal transmitted when the end of the lock hook (2) opposite to the torsion spring (21) presses the travel switch (15), and an unlocking signal transmitted when the end of the lock hook (2) opposite to the torsion spring (21) presses the travel switch (15) according to the predetermined Persian password.

12. The bag lock according to claim 11, wherein when the unlocking signal is transmitted by the travel switch (15), the controller (18) is configured to control the second rotating shaft (141*a*) of the motor main body (141) to rotate, then the third limiting portion (142*d*) of the motor block (142) is driven to rotate to enter the third limiting groove (124) of the rotating block (12), thereby the rotating block (12) is pushed to rotate, so that the unlocking wall (123) of the rotating block (12) is separated from the second limiting slot (112*b*) of the lock bolt assembly (11) to unlock the bag lock, while the arc-shaped outer peripheral wall of the blocking portion (142*c*) of the motor block (142) abuts against the first concave wall (125*a*) of the rotating block (12); and wherein when the travel switch (15) transmits the locking signal, the controller (18) is configured to control the second rotating shaft (141*a*) of the motor main body (141) to rotate, then the third limit portion (142*d*) of the motor block (142) is driven to rotate to enter the third limiting groove (124) of the rotating block (12), thereby the rotating block (12) is pushed to rotate, so that the locking wall (122) of the rotating block (12) enters into the second limiting slot (112*b*) of the lock bolt assembly (11) to lock the bag lock, while the arc-shaped outer peripheral wall of the blocking portion (142*c*) of the motor block (142) abuts against the second concave wall (125*b*) of the rotating block (12).

13. The bag lock according to claim 12, wherein a housing (3) of the lock body (1) comprises:

a first button (31) electrically connected to the controller (18) for adding preset fingerprints to the controller (18) or deleting stored preset fingerprints from the controller (18) when pressed by a user;

a second key (32) electrically connected to the controller (18) for setting the predetermined Persian password stored by the controller 18 when pressed by a user; and the first button (31) and the second button (32) are also configured to reset the controller (18) to factory settings when pressed at the same time.

14. The bag lock according to claim 13, wherein the predetermined Persian password comprises at least a first duration Persian password and a second duration Persian password of different durations arranged in a preset order;

the housing (3) of the lock body (1) is further provided with:

a first indicator (33) electrically connected to the controller (18) for emitting light under the following conditions: when a bag lock function is turned on, when the travel switch (15) is pressed by the first duration Persian password, and the user is authorized to set a preset fingerprint or a predetermined Persian password;

a second indicator light (34) connected to the controller (18) for emitting light under the following conditions: when the bag lock is unlocked successfully, when the user sets the preset fingerprint or the predetermined Persian password successfully, and when the travel switch (15) is pressed by the second duration Persian password; and a third indication (35) connected to the controller (18) and the battery (17) and configured to emit light when the user fails to unlock the bag lock and fails to set the preset fingerprint or the predetermined Persian password, and when a battery power is lower than a preset power.

15. An unlocking method for controlling the bag lock according to claim 1, wherein comprising following steps:

S1, pressing one end of the lock hook (2) which is opposite to the torsion spring (21) according to a predetermined Persian password, so that its bottom portion is pressed on a travel switch (15) defined on a bottom part of the lock hole (10) according to the predetermined Persian password;

S2, the travel switch (15) transmits an unlocking signal, a controller (18) controls a second rotating shaft (141*a*) of a motor main body (141) to rotate to drive a third limit portion (142*d*) to rotate, thereby pushing a third limiting groove (124) to rotate;

S3, the third limiting groove (124) drives the rotating block (12) to rotate so that an unlocking wall (123) of the rotating block (12) faces to a second limiting slot (112*b*) of the lock bolt assembly (11), and the rotating block (12) is disengaged from the second limiting slot (112*b*);

S4, the torsion spring (21) provides the torsion force for disengaging the first limiting slot (22) of the lock hook (2) from the lock hole (10), and the torsion force is greater than an elastic force of a transverse arch (111) of the lock bolt assembly (11) pushing a transverse bolt (112) into the first limiting slot (22), the first limiting slot (22) is disengaged from a first limiting portion (112*a*), and the bag lock is unlocked.

16. An unlocking method for controlling the bag lock according to claim 1, wherein comprising following steps:

S1, pressing one end of the lock hook (2) which is opposite to the torsion spring (21) so that its bottom portion is pressed on a travel switch (15) defined on a bottom part of the lock hole (10), then the travel switch (15) transmits a pressure signal to a controller (18);

S2, the controller (18) controls a fingerprint recognition assembly (16) to receive the pressure signal and activates from a dormant state to recognize a user's fingerprint, the fingerprint recognition assembly (16) passes a recognized fingerprint to the controller (18), the controller (18) compares the recognized fingerprint with a preset fingerprint, when the recognized fingerprint is the same as the preset fingerprint, the controller (18) controls a second rotating shaft (141*a*) of a motor main body (141) to rotate to drive a third limiting portion (142*d*) to rotate, thereby pushing a third limiting groove (124) to rotate;

S3, the third limiting groove (124) drives the rotating block (12) to rotate so that an unlocking wall (123) of the rotating block (12) faces to a second limiting slot (112*b*) of the lock bolt assembly (11), and the rotating block (12) is disengaged from the second limiting slot (112*b*);

S4, the torsion spring (21) provides the torsion force for disengaging the first limiting slot (22) of the lock hook (2) from the lock hole (10), and the torsion force is greater than an elastic force of a transverse arch (111) of the lock bolt assembly (11) pushing a transverse bolt (112) into the first limiting slot (22), the first limiting slot (22) is disengaged from a first limiting portion (112*a*), and the bag lock is unlocked.

* * * * *